US007024970B2

(12) United States Patent
Boman

(10) Patent No.: US 7,024,970 B2
(45) Date of Patent: Apr. 11, 2006

(54) SOCKET WRENCH

(76) Inventor: Tore Boman, Vrana Sateri, S-697 94 Skollersta (SE)

( * ) Notice: Subject to any disclaimer, the term of this patent is extended or adjusted under 35 U.S.C. 154(b) by 0 days.

(21) Appl. No.: 10/380,770

(22) PCT Filed: Sep. 27, 2001

(86) PCT No.: PCT/SE01/02075

§ 371 (c)(1),
(2), (4) Date: Mar. 25, 2003

(87) PCT Pub. No.: WO02/27195

PCT Pub. Date: Apr. 4, 2002

(65) Prior Publication Data

US 2004/0020329 A1 Feb. 5, 2004

(30) Foreign Application Priority Data

Sep. 28, 2000 (SE) ..... 0003470

(51) Int. Cl.
*B25B 23/16* (2006.01)

(52) U.S. Cl. ..... 81/177.8; 81/125.1

(58) Field of Classification Search ..... 81/177.8, 81/177.9, 177.6, 177.7, 124.3, 124.2, 124.5, 81/125.1

See application file for complete search history.

(56) References Cited

U.S. PATENT DOCUMENTS

| | | | | | |
|---|---|---|---|---|---|
| 65,550 | A | * | 6/1867 | Dunlap | 81/124.5 |
| 1,292,285 | A | * | 1/1919 | Fairchild | 81/177.6 |
| 1,331,956 | A | * | 2/1920 | Cross | 81/177.8 |
| 1,434,401 | A | * | 11/1922 | Mueller | 81/124.2 |
| 1,530,842 | A | * | 3/1925 | Matoushek | 81/177.8 |
| 1,571,148 | A | * | 1/1926 | Sisolak | 81/124.5 |
| 1,805,298 | A | * | 5/1931 | Schweigert | 81/177.8 |
| 1,811,137 | A | * | 6/1931 | Kress | 81/124.3 |
| 2,549,515 | A | * | 4/1951 | Orey et al. | 81/124.3 |
| 2,680,985 | A | * | 6/1954 | Fish | 81/177.7 |
| 4,305,438 | A | * | 12/1981 | Spinosa et al. | 81/124.3 |
| 5,331,869 | A | * | 7/1994 | Webb | 81/177.1 |
| 6,112,625 | A | * | 9/2000 | Turtle | 81/177.2 |

* cited by examiner

*Primary Examiner*—Hadi Shakeri
(74) *Attorney, Agent, or Firm*—Dennison, Schultz, Dougherty & MacDonald

(57) ABSTRACT

A socket wrench includes a socket element which is provided with a socket or engagement with a bolt or nut, and a hinge to act in combination with a handle and which forms a lever arm when tightening or loosening bolts or nuts. The handle is fitted at a first end thereof with a hinge half to act in combination with a socket element having a second hinge half. The handle is fitted at a second end thereof with a hinge and a socket element or other form of nut wrench.

5 Claims, 5 Drawing Sheets

SOCKET WRENCH

BACKGROUND OF THE INVENTION

The present invention is concerned with a socket wrench comprising a socket element which is provided with a socket for engagement with a bolt or nut, and a handle which forms a lever arm when tightening or loosening nuts or bolts, which handle is fitted at a first end thereof with a hinge half for the purpose of acting in combination with a socket element fitted with a hinge half on an upper part thereof. The invention is further concerned with a second socket element hinged to a second end of the handle, or other nut wrench or similar attached to a second end of the handle.

Socket wrenches are used for tightening or loosening bolts or nuts in threaded joints that are inaccessible by non-hinged tools. Socket wrenches available on the market have a socket for engagement with the bolt or nut. The socket is located in a socket element with the hinge located above the socket of the socket element, which is fitted with a handle attached to the hinge, which handle forms a lever when tightening or loosening bolts or nuts in a threaded joint.

The drawback of socket wrenches is the location of the hinge at the top of the socket element, which restricts the ability to tighten or loosen nuts on bolts having a thread length greater than the depth of the socket of the socket element.

SUMMARY OF THE INVENTION

The purpose of the present invention is to make available a socket wrench in which the depth of the socket element does not limit the construction of the threaded joint in respect of the length or position of the bolt.

This is achieved by means of a socket wrench of the type described in the ingress, wherein the socket element has an opening in the side thereof opposite to the socket.

Another purpose of the present invention is to make available a socket wrench which may be applied sideways to a threaded joint or threaded pipe joint, wherein the profile of the handle assists the profile of the socket element.

Such a socket wrench, having such a socket element and handle profile, enables more complex threaded joints to be used, implying implies that the socket wrench can be applied to existing complex threaded joints without complete or partial disassembly.

BRIEF DESCRIPTION OF THE DRAWINGS

The invention will be described more particularly with reference to embodiments shown in the attached drawings, where.

DETAILED DESCRIPTION OF THE INVENTION

Figure 1:
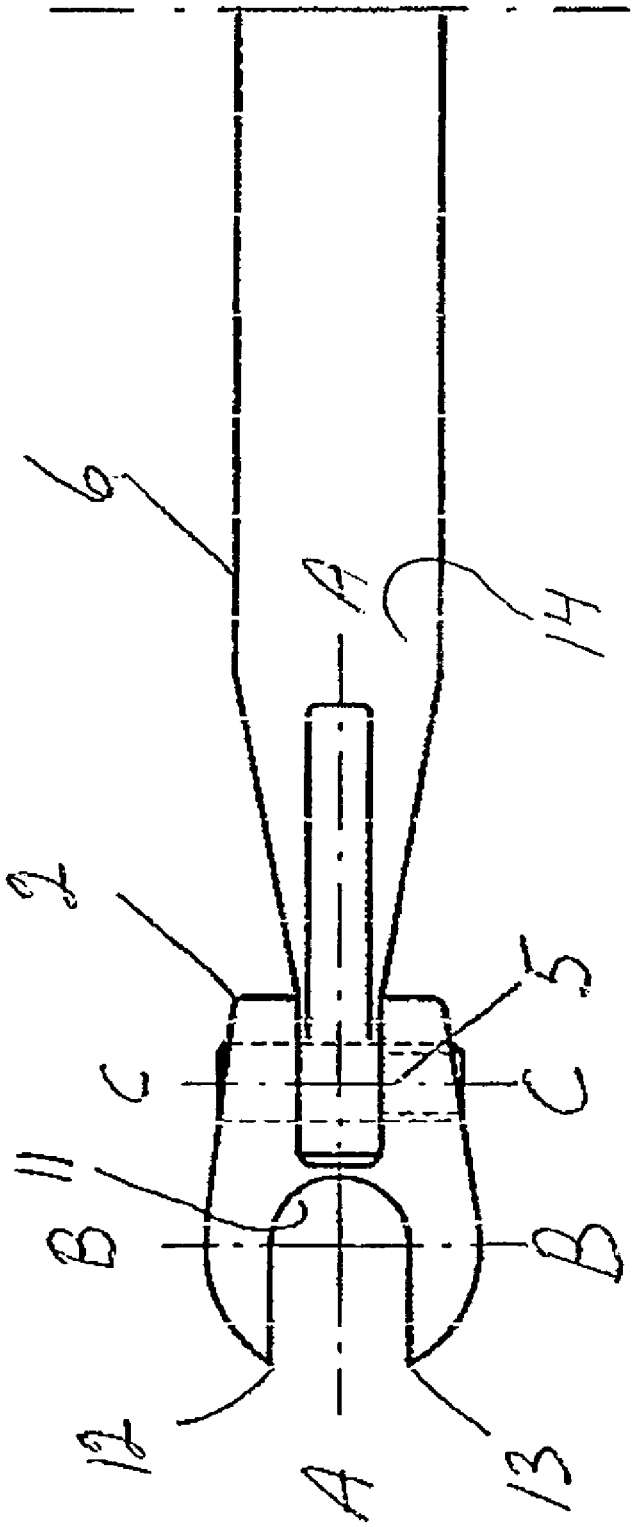
FIG. 1 shows a view of a socket wrench according to the present invention, with an open socket element, hinge, and handle with U-shaped profile.

FIG. 1 shows the socket element (2) according to the present invention. In the socket element (2) an opening is provided which according to the illustrated embodiment displays a substantially U-shaped through profile (11). The U-shaped through profile (11) is formed by a gap in the envelope surface between points (12) and (13), whereby the socket element (2) can be applied to threaded pipe joints, threaded hydraulic joints etc. The U-shaped through profile (11) is intersected by line B-B of the socket element (2), where the hinge is located in older socket wrenches. The hinge (5) is intersected by line C—C, which confers unique properties upon the socket element (2) in combination with the hinge (5) and the handle (6) with U-shaped profile (14).

Figure 2:
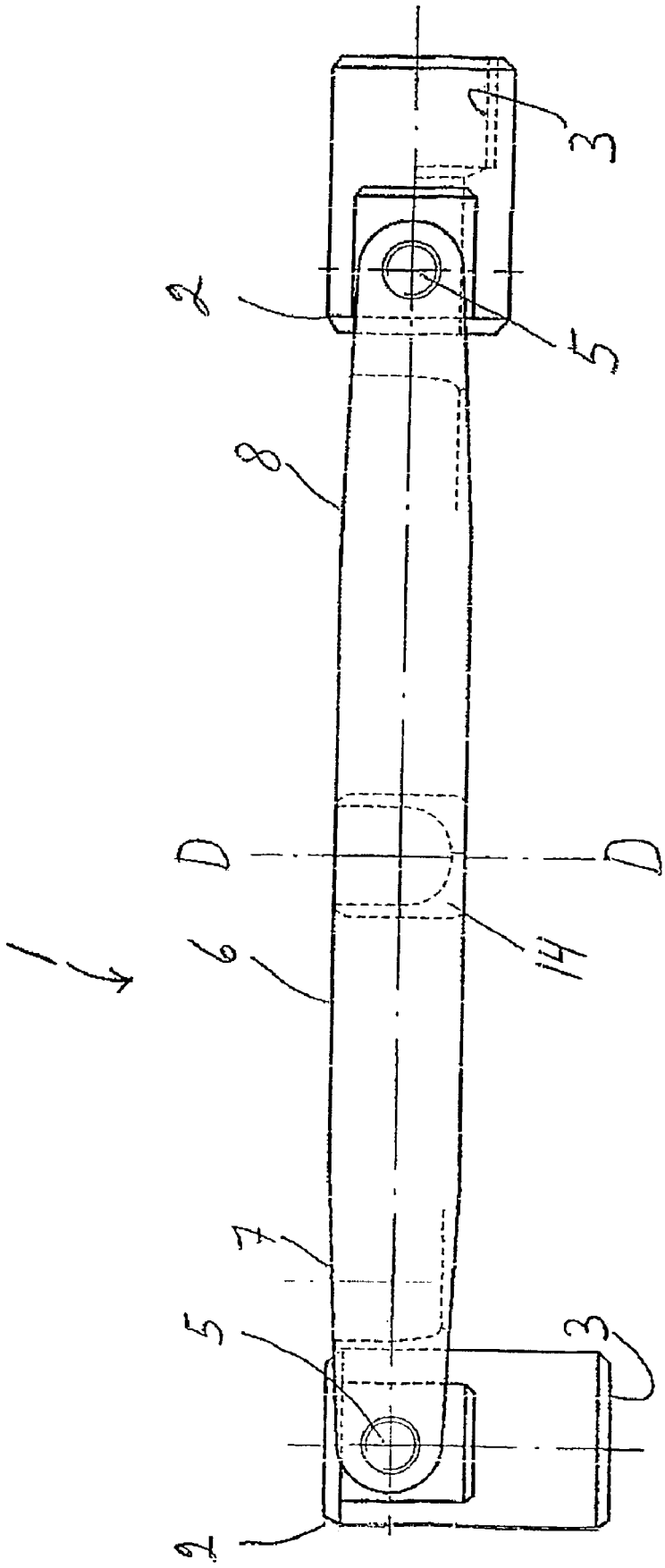
FIG. 2 shows a socket wrench according to the present invention, with an open socket element, hinge, and U-shaped profile of handle, with a section on line D—D.

FIG. 2 shows a socket wrench according to the present invention. The socket wrench (1) comprises a socket element (2), which is provided with a socket (3) for engagement with a bolt or a nut of a threaded joint. The socket element (2) is attached to a first end (7) of the handle (6) by means of a hinge (5). The handle (6) thus constitutes a lever arm for the socket wrench (1) when tightening or loosening bolts or nuts when making or undoing a threaded joint. The handle (6) is provided with a U-shaped profile (14) in its longitudinal, see section on line D—D. At the second end (8) of the handle a similar socket element (2) is attached by means of a hinge (5). This provides the ability to apply the socket wrench (1) to a nut or bolt of a threaded joint from a position which has not previously been possible for socket wrenches.

Figure 3:
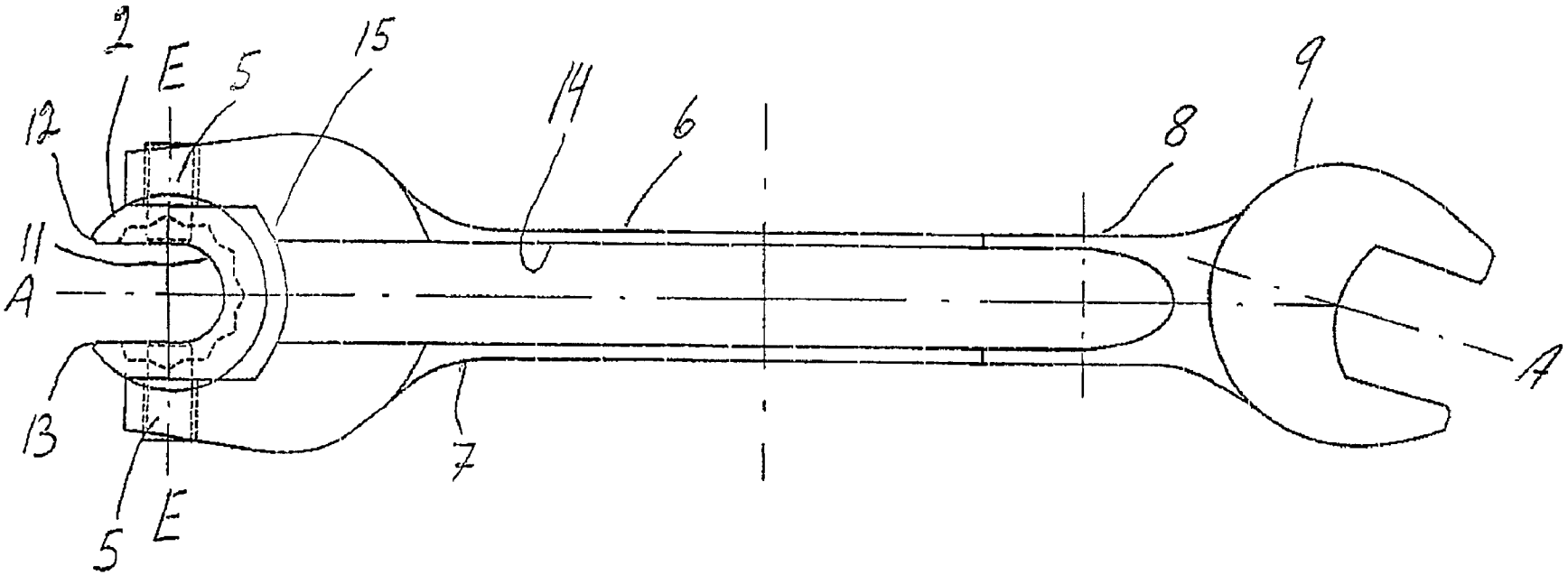
FIG. 3 shows a socket wrench according to the present invention, with an open socket element, hinge, and handle with U-shaped profile.

FIG. 3 shows a view of a socket wrench according to the present invention. In the socket element (2) there is provided an opening which according to the illustrated embodiment displays a substantially U-shaped through profile (11). The U-shaped through profile (11) is formed by a gap in the envelope surface between point (12) and point (13), whereby the socket element (2) can be applied from the side to threaded pipe joints, threaded hydraulic joints etc. Two hinges (5) are provided, one on each side of the socket element (2), along the line E—E, to act in combination with the socket element (2) and the U-shaped profile (14) of the handle (6). At the first end (7) of the handle (6) there is provided a forked joint (15) to retain the socket element (2) in combination with two hinges (5). However, it is possible for the second end (8) of the handle (6) to display another embodiment in the form of nut wrenches (9).

Figure 4:
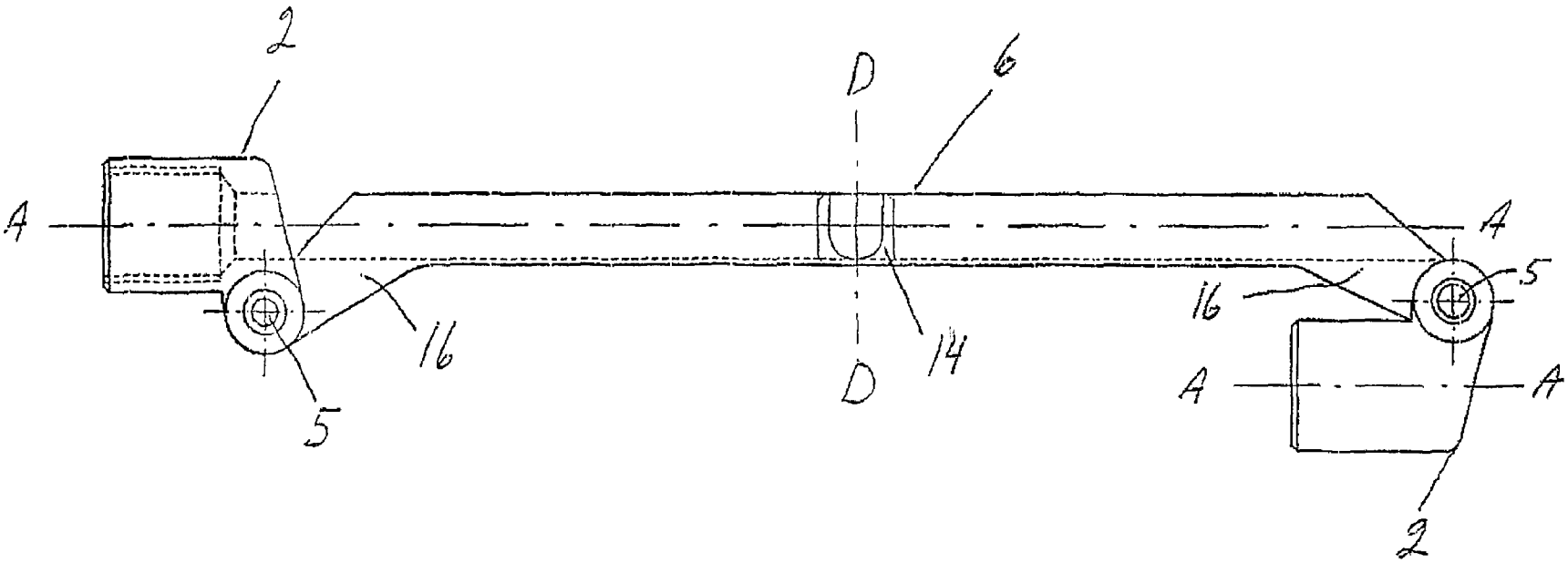
FIG. 4 shows a socket wrench according to the present invention, with a socket element, hinge, and a handle with U-shaped profile and cranked end.
Figure 5:
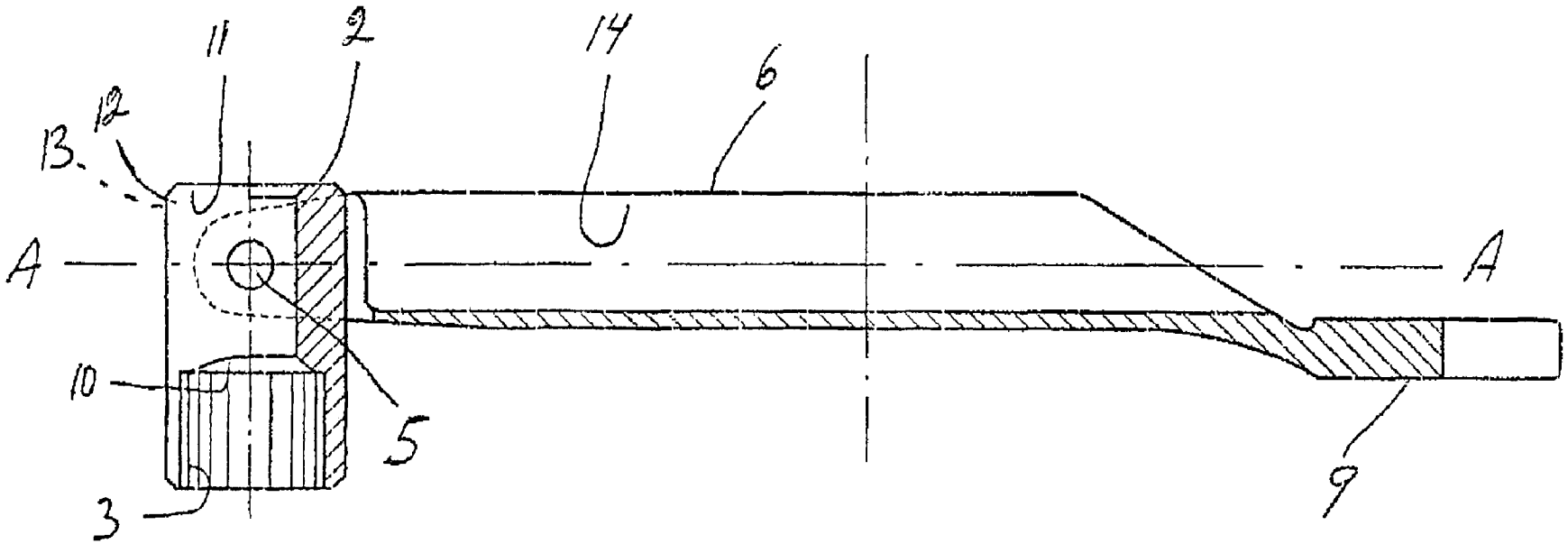
FIG. 5 shows a section on line A—A in FIG. 3.

FIG. 4 shows the handle (6), hinge (5) and socket element (2) of a socket wrench according to the present invention. The handle (6) is provided with a U-shaped longitudinal profile (14), see section on line D—D, with a cranked end (16) which retains the hinge so as to act in combination with the socket element (2).

The socket element (2) and the handle (6) can be fabricated by e.g. forging or casting with after-machining as necessary. In the embodiments shown in the figures, the hinge (5) is fabricated from a steel pin. However, it is possible for the hinge (5) to be fabricated by other methods, as a threaded joint or similar.

The invention claimed is:

1. A socket wrench, comprising:

a first socket element having a first socket, said first socket element having a first axis;

a second socket element having a second socket, said second socket element having a second axis;

a lever arm having a handle portion including a first end and an opposing second end, and an elongated channel-type opening on one side thereof and having a substantially U-shaped configuration, said elongated channel-type opening having a longitudinal axis;

said lever arm having a first angled end portion attached to said handle portion first end and a second angled end portion attached to said handle portion second end;

a first hinge;

a second hinge;

wherein said first socket element is dimensioned and configured and is pivotally mounted to said first angled end portion via said first hinge wherein said first axis is collinear with said elongated channel-type opening longitudinal axis when said first socket is in a first position, and said second socket element is dimensioned and configured and is pivotally mounted to said second angled end portion via said second hinge wherein said second axis is collinear with said longitudinal axis when said second socket element is in a second position, wherein said first socket element, said elongated channel-type opening, and said second socket element provide a continuous channel for receiving a work piece therein when said first socket element is in said first portion and said second socket element is in said second position.

2. The socket wrench of claim 1, wherein said first hinge and said second hinge each has an axis of rotation perpendicular to said longitudinal axis.

3. The socket wrench of claim 1, wherein said first socket has a U-shaped profile.

4. The socket wrench of claim 1, wherein said first socket has a rebate for a nut or bolt to rest on.

5. The socket wrench of claim 1, wherein said lever arm first end has a fork-shaped configuration, and wherein said lever arm second end has a fork-shaped configuration.

* * * * *